US009440449B2

(12) United States Patent
Tamai

(10) Patent No.: US 9,440,449 B2
(45) Date of Patent: Sep. 13, 2016

(54) PRINTING CONTROL DEVICE, PRINTING CONTROL METHOD, AND PRINTING CONTROL PROGRAM

(71) Applicant: SEIKO EPSON CORPORATION, Tokyo (JP)

(72) Inventor: Takashi Tamai, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/601,109

(22) Filed: Jan. 20, 2015

(65) Prior Publication Data

US 2015/0202876 A1 Jul. 23, 2015

(30) Foreign Application Priority Data

Jan. 23, 2014 (JP) ..... 2014-010282

(51) Int. Cl.
*B41J 2/21* (2006.01)

(52) U.S. Cl.
CPC ..... *B41J 2/2139* (2013.01); *B41J 2/2132* (2013.01); *B41J 2/2142* (2013.01)

(58) Field of Classification Search
CPC .. B41J 2/0458; B41J 2/04563; B41J 29/393; B41J 2/04591; B41J 2/04581; B41J 2/2139; B41J 2/2132; B41J 2/2142
USPC ..... 347/14
See application file for complete search history.

(56) References Cited

U.S. PATENT DOCUMENTS 6,659,580 B2 12/2003 Horikoshi
2004/0119766 A1* 6/2004 Shibata ..... B41J 2/5056 347/12
2004/0135844 A1* 7/2004 Yang ..... B41J 2/15 347/40
2007/0285463 A1* 12/2007 Kanda ..... B41J 2/1433 347/40
2012/0154837 A1* 6/2012 Yamazaki ..... 358/1.9

FOREIGN PATENT DOCUMENTS

JP 2000-094662 A 4/2000

* cited by examiner

*Primary Examiner* — Manish S Shah
*Assistant Examiner* — Yaovi M Ameh
(74) *Attorney, Agent, or Firm* — Maschoff Brennan

(57) ABSTRACT

A printing control device includes a nozzle information obtainment unit that obtains the position of a discharge-failing nozzle which fails to discharge ink in a printing head which includes a nozzle array, a data generation unit that generates printing data in which a dot position is associated with a nozzle which discharges ink so that a raster which is one line and is configured by a plurality of dot positions is configured through multiple times of a scan, and a data correction unit that specifies a first position which is the position where ink is discharged by a discharge-failing nozzle and corrects the printing data so that non-discharge of ink is associated with the first position, and discharge of ink is associated with a second position between which the first position is interposed when discharge of ink is associated with the first position in the printing data generated.

7 Claims, 14 Drawing Sheets

FIG. 12A

| | 1 | 2 | 3 | 4 | 5 | 6 | 7 |
|---|---|---|---|---|---|---|---|
| 1 | 1 | 2 | 1 | 2 | 1 | 2 | 1 |
| 2 | 1 | 2 | 1 | 2 | 1 | 2 | 1 |
| 3 | 1 | × | 1 | × | 1 | × | 1 |
| 4 | 3 | 2 | 3 | 2 | 3 | 2 | 3 |
| 5 | 3 | 2 | 3 | 2 | 3 | 2 | 3 |
| 6 | × | 2 | × | 2 | × | 2 | × |
| 7 | 3 | 4 | 3 | 4 | 3 | 4 | 3 |
| 8 | 3 | 4 | 3 | 4 | 3 | 4 | 3 |
| 9 | 3 | × | 3 | × | 3 | × | 3 |

FIG. 12B

| | 1 | 2 | 3 | 4 | 5 | 6 | 7 |
|---|---|---|---|---|---|---|---|
| 1 | | | 1 | | | | |
| 2 | 1 | | | | 1 | | 1 |
| 3 | | × | | | | × | |
| 4 | 3 | | | 2 | | | |
| 5 | | | 3 | | 3 | | 3 |
| 6 | | 2 | × | | × | | |
| 7 | | | | | 3 | 4 | |
| 8 | | 4 | | | | | |
| 9 | 3 | | | × | | × | |

FIG. 12C

| | 1 | 2 | 3 | 4 | 5 | 6 | 7 |
|---|---|---|---|---|---|---|---|
| 1 | | | 1 | | | | |
| 2 | 1 | 2 | | | 1 | 2 | 1 |
| 3 | | | | | | | |
| 4 | 3 | 2 | | 2 | | 2 | |
| 5 | | | 2, 3 | | 2, 3 | | 3 |
| 6 | | 2 | | | | | |
| 7 | | | 3 | | 3, 4 | 4 | |
| 8 | | 4 | | 4 | | 4 | |
| 9 | 3 | | | | | | |

FIG. 13A

432A

| No. | MISSING PIXEL | COMPLEMENTATION PIXEL |
|---|---|---|
| 1 | DOT ON | DOT ON |
| 2 | DOT ON | DOT OFF |
| 3 | DOT OFF | DOT ON |
| 4 | DOT OFF | DOT OFF |

FIG. 13B

432B

| No. | MISSING PIXEL | COMPLEMENTATION PIXEL |
|---|---|---|
| 1 | DOT OFF | DOT ON<br>DOUBLE HIT |
| 2 | DOT OFF | DOT ON |
| 3 | DOT OFF | DOT ON |
| 4 | DOT OFF | DOT OFF |

PRINTING CONTROL DEVICE, PRINTING CONTROL METHOD, AND PRINTING CONTROL PROGRAM

CROSS-REFERENCE TO RELATED APPLICATIONS

This application claims priority to Japanese Patent Application No. 2014-010282 filed on Jan. 23, 2014. The entire disclosure of Japanese Patent Application No. 2014-010282 is hereby incorporated herein by reference.

BACKGROUND

1. Technical Field

The present invention relates to a printing control device, a printing control method, and a printing control program.

2. Related Art

A recording apparatus is disclosed in JP-A-2000-94662. The recording apparatus generates a mask table for outputting recording data that corresponds to each scan in multiple times of the scan, modifies the content of the mask table generated on the basis of a discharge unit in which discharge failure occurs among a plurality of discharge units, and outputs the recording data that corresponds to the plurality of discharge units in each scan in multiple times of the scan using the mask table generated or the mask table modified on the basis of image information related to an image to be recorded. Here, the discharge failure is so-called missing of nozzles and, for example, means that an eye of a nozzle is clogged due to a reason such as the viscosity of ink increasing, thus not being capable of discharging ink.

In the invention described in JP-A-2000-94662, multipass printing is used to print one raster with a plurality of different nozzles. Ink is discharged by a different nozzle in a different pass to a pixel to which a nozzle that fails to discharge ink is supposed to originally discharge ink.

However, the invention described in JP-A-2000-94662 cannot be applied to a case where ink cannot be discharged by a different nozzle to a pixel to which a nozzle that fails to discharge ink is supposed to originally discharge ink.

SUMMARY

An advantage of some aspects of the invention is to provide a printing control device, a printing control method, and a printing control program that can suppress decrease in image quality due to discharge failure even when a normal nozzle does not discharge ink to a pixel to which a nozzle which fails to discharge ink is supposed to originally discharge ink.

According to a first aspect of the invention, there is provided a printing control device including a nozzle information obtainment unit that obtains the position of a discharge-failing nozzle which fails to discharge ink in a printing head which includes a nozzle array in which a plurality of nozzles discharging ink to a printing medium is lined up in a transport direction of the printing medium, a data generation unit that generates printing data in which a dot position is associated with a nozzle which discharges ink so that a raster which is one line in a scanning direction of the printing head and is configured by a plurality of dot positions is configured through multiple times of a scan, and a data correction unit that specifies a first position which is the position where ink is discharged by a discharge-failing nozzle in the printing data on the basis of the position of the discharge-failing nozzle obtained and corrects the printing data so that non-discharge of ink is associated with the first position, and discharge of ink is associated with a second position between which the first position is interposed along the transport direction when discharge of ink is associated with the first position in the printing data generated.

In this case, the position of a discharge-failing nozzle in the printing head which includes the nozzle array in which the plurality of nozzles discharging ink to the printing medium is lined up in the transport direction of the printing medium is obtained. In addition, the first position which is the position where ink is discharged by a discharge-failing nozzle in the printing data which is generated so that the raster which is one line in the scanning direction of the printing head is configured through multiple times of the scan, and ink is not discharged twice or more to each of the plurality of dot positions which constitutes the raster is specified. Furthermore, the printing data is corrected so that non-discharge of ink is associated with the first position, and discharge of ink is associated with the second position between which the first position is interposed along the transport direction when discharge of ink is associated with the first position in the printing data generated. Accordingly, decrease in image quality due to discharge failure can be suppressed even when ink is not discharged by a normal nozzle to a pixel where a nozzle that fails to discharge ink is supposed to originally discharge ink.

It is preferable that the data correction unit correct the printing data so that ink is discharged multiple times to the second position when discharge of ink is associated with the second position in the printing data generated. In this case, a dot that is supposed to be originally formed at the second position is formed, and a blank due to discharge failure can be prevented from standing out.

It is preferable that the data correction unit correct the printing data so that ink is discharged by using a nozzle that is associated with the second position in the printing data generated and nozzles that are associated with positions which are adjacent to the second position in the same raster in which the second position is in the printing data generated when ink is discharged multiple times to the second position. In this case, a dot can be formed at the same dot position through different passes.

It is preferable that the data correction unit do not correct the printing data when discharge of ink is not associated with the first position in the printing data generated. In this case, unnecessary forming of dots can be prevented.

It is preferable that the nozzle information obtainment unit obtain a plurality of discharge-failing nozzles, the first position be a position where ink is discharged by each of the plurality of discharge-failing nozzles obtained, and the data correction unit correct the printing data so that ink is discharged in one scan to every dot position that constitutes the raster and is the second position when the first position is the entire raster. In this case, ink can be discharged twice through different passes to every dot position that constitutes the raster and is the second position.

It is preferable that the printing control device further include an output unit that outputs the printing data corrected by the data correction unit and outputs an instruction to reduce a speed at which the printing head is moved in the scanning direction by half when the second positions are adjacent to each other in the raster compared with when the second positions are not adjacent to each other in the raster. In this case, dots can be stably formed continuously at the adjacent dot positions by using the same nozzle.

According to a second aspect of the invention, there is provided a printing control method including obtaining the position of a discharge-failing nozzle which fails to discharge ink in a printing head which includes a nozzle array in which a plurality of nozzles discharging ink on a printing medium are lined up in a transport direction of the printing medium, generating printing data in which a dot position is associated with a nozzle which discharges ink so that a raster which is one line in a scanning direction of the printing head and is configured by a plurality of dot positions is configured through multiple times of a scan, and specifying a first position which is the position where ink is discharged by a discharge-failing nozzle in the printing data on the basis of the position of the discharge-failing nozzle obtained and correcting the printing data so that non-discharge of ink is associated with the first position, and discharge of ink is associated with a second position between which the first position is interposed along the transport direction when discharge of ink is associated with the first position in the printing data generated. In this case, decrease in image quality due to discharge failure can be suppressed even when ink is not discharged by a normal nozzle to a pixel where a nozzle that fails to discharge ink is supposed to originally discharge ink.

According to a third aspect of the invention, there is provided a printing control program that causes a computer to function as a printing control device and to execute obtaining the position of a discharge-failing nozzle which fails to discharge ink in a printing head which includes a nozzle array in which a plurality of nozzles discharging ink on a printing medium are lined up in a transport direction of the printing medium, generating printing data in which a dot position is associated with a nozzle which discharges ink so that a raster which is one line in a scanning direction of the printing head and is configured by a plurality of dot positions is configured through multiple times of a scan, and specifying a first position which is the position where ink is discharged by a discharge-failing nozzle in the printing data on the basis of the position of the discharge-failing nozzle obtained and correcting the printing data so that non-discharge of ink is associated with the first position, and discharge of ink is associated with a second position between which the first position is interposed along the transport direction when discharge of ink is associated with the first position in the printing data generated. In this case, decrease in image quality due to discharge failure can be suppressed even when ink is not discharged by a normal nozzle to a pixel where a nozzle that fails to discharge ink is supposed to originally discharge ink.

BRIEF DESCRIPTION OF THE DRAWINGS

The invention will be described with reference to the accompanying drawings, wherein like numbers reference like elements.

FIG. 12A is a diagram illustrating which nozzle discharges ink to each dot position in the dot data, FIG. 12B is a diagram illustrating the raster graphic data before correction, and FIG. 12C is a diagram illustrating the raster graphic data after correction.

FIGS. 13A and 13B are diagrams illustrating an example of a complementation table. FIG. 13A illustrates conditions of discharging ink before a complementation process, and FIG. 13B illustrates conditions of discharging ink after the complementation process.

DESCRIPTION OF EXEMPLARY EMBODIMENTS

Embodiments of the invention will be described with reference to the accompanying drawings.

First Embodiment

Figure 1:
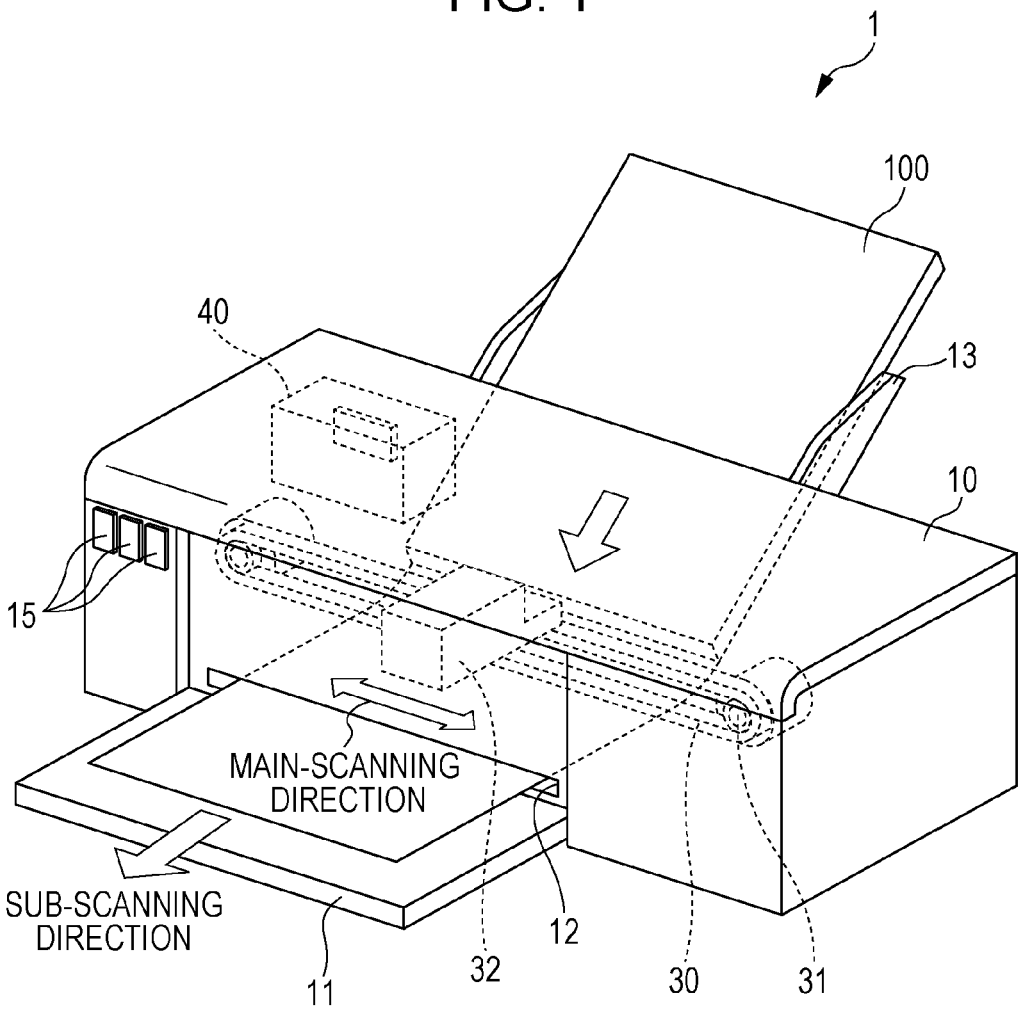
FIG. 1 is a diagram illustrating an example of the configuration of a printing apparatus in a first embodiment.

FIG. 1 is a diagram illustrating an example of the configuration of a printing apparatus 1 in an embodiment of the invention. The printing apparatus 1 in a first embodiment is a so-called ink jet printer that prints an image by ejecting ink to an outer surface of a printing medium 100.

A casing 10 is shaped as an exterior of a box, and a front cover 11 is disposed at a substantially center of the front surface of the casing 10. A plurality of operation buttons 15 is disposed near the front cover 11. The front cover 11 is axially supported on the lower end side thereof. An elongated discharge port 12 where the printing medium 100 is discharged appears when the upper end side of the front cover 11 is pulled forward.

A sheet feed tray 13 is disposed on the rear surface side of the casing 10. When the printing medium 100 is set in the sheet feed tray 13, and the operation button 15, a personal computer (PC), or the like is operated to perform a printing instruction, the printing medium 100 is fed from the sheet feed tray 13. The printing medium 100 is discharged from the discharge port 12 after an image is printed on the outer surface of the printing medium 100 inside the casing 10.

Mainly, a control unit 40 is disposed inside the casing 10. The control unit 40 controls the entire printing apparatus 1 by executing firmware. The control unit 40 will be described in detail below. Meanwhile, the control unit 40 does not need to be disposed inside the casing 10. The control unit 40, for example, may be provided in an apparatus such as a PC that is connected to the printing apparatus 1. When the control unit 40 is provided in an apparatus such as a PC, the control unit 40 may control the entire printing apparatus 1 by executing a printer driver.

Figure 2:
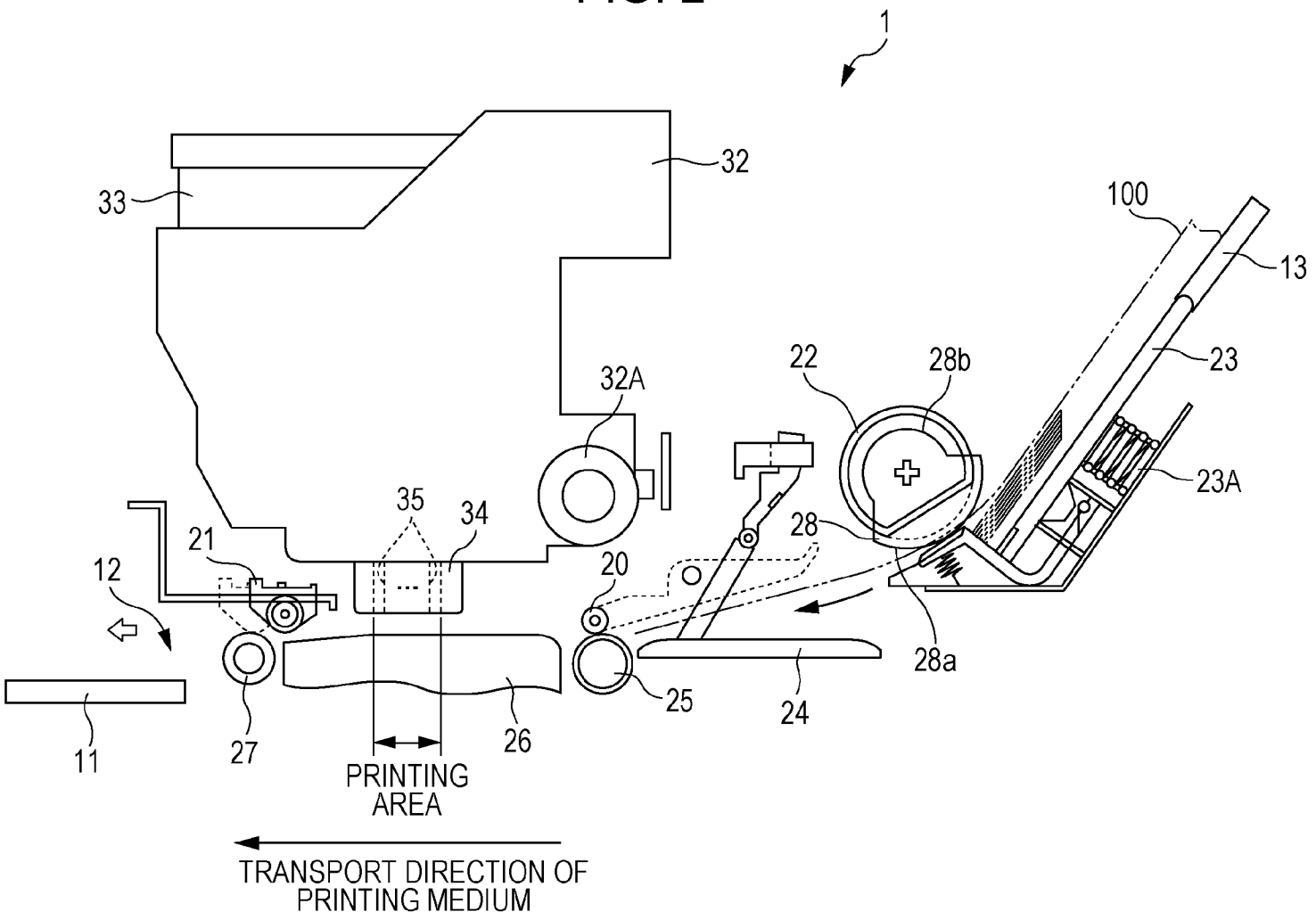
FIG. 2 is a diagram illustrating an example of the configuration of a transport mechanism and an ink discharge mechanism of the printing apparatus.

The printing apparatus 1 includes a transport mechanism that transports the printing medium 100 mounted in the sheet feed tray 13 to the discharge port 12 and an ink discharge mechanism that discharges ink to a printing medium such as the printing medium 100 transported by the transport mechanism. FIG. 2 is a diagram illustrating an example of the configuration of the transport mechanism and the ink discharge mechanism.

The transport mechanism includes an LD roller 22 as a first sheet feed roller, a hopper 23 as a nipping member, a sheet guide 24, a PF roller 25 as a second sheet feed roller, a platen 26, a sheet discharge roller 27, and the like.

The hopper 23 is biased toward the LD roller 22 by the force of a hopper spring 23A. Accordingly, a convex portion formed in a lower end portion of the hopper 23 fits a concave portion of a gapping cam 28 when the printing apparatus 1 is stopped.

The lower end edge of the hopper 23 is separated from the concave portion of the gapping cam 28 and abuts a large diameter portion 28*a* of the gapping cam 28 when the LD roller 22 rotates counterclockwise in FIG. 2. The lower end edge of the hopper 23 is separated from the large diameter portion 28*a* of the gapping cam 28 and abuts a small diameter portion 28*b* of the gapping cam 28 when the LD roller 22 further rotates counterclockwise in FIG. 2. Consequently, the printing medium 100 is nipped by the LD roller 22 and the hopper 23.

When the LD roller 22 further rotates counterclockwise in FIG. 2, the printing medium 100 is transported in a lower left direction (refer to the arrow) in FIG. 2 in response to the rotation of the LD roller 22 and is supplied to a printing area (will be described in detail below) by the sheet guide 24, the PF roller 25, and the like. The printing medium 100 is discharged by the sheet discharge roller 27 after printing.

The ink discharge mechanism is arranged on the upper side (upper side in FIG. 2) of the transport mechanism that has the above configuration. The ink discharge mechanism mainly includes a carriage 32, an ink tank 33, a printing head 34, and the like.

The carriage 32 is positioned over the platen 26. The carriage 32 is connected to a drive unit that includes a timing belt 30 (refer to FIG. 1) inside which a plurality of teeth shapes are formed and a drive motor 31 (refer to FIG. 1) which drives the timing belt 30. The carriage 32 moves in the axial direction (main-scanning direction) of a carriage shaft 32A when the timing belt 30 is driven.

The printing head 34 that includes a plurality of nozzle arrays 35 is arranged on the lower surface of the carriage 32.

Figure 3:
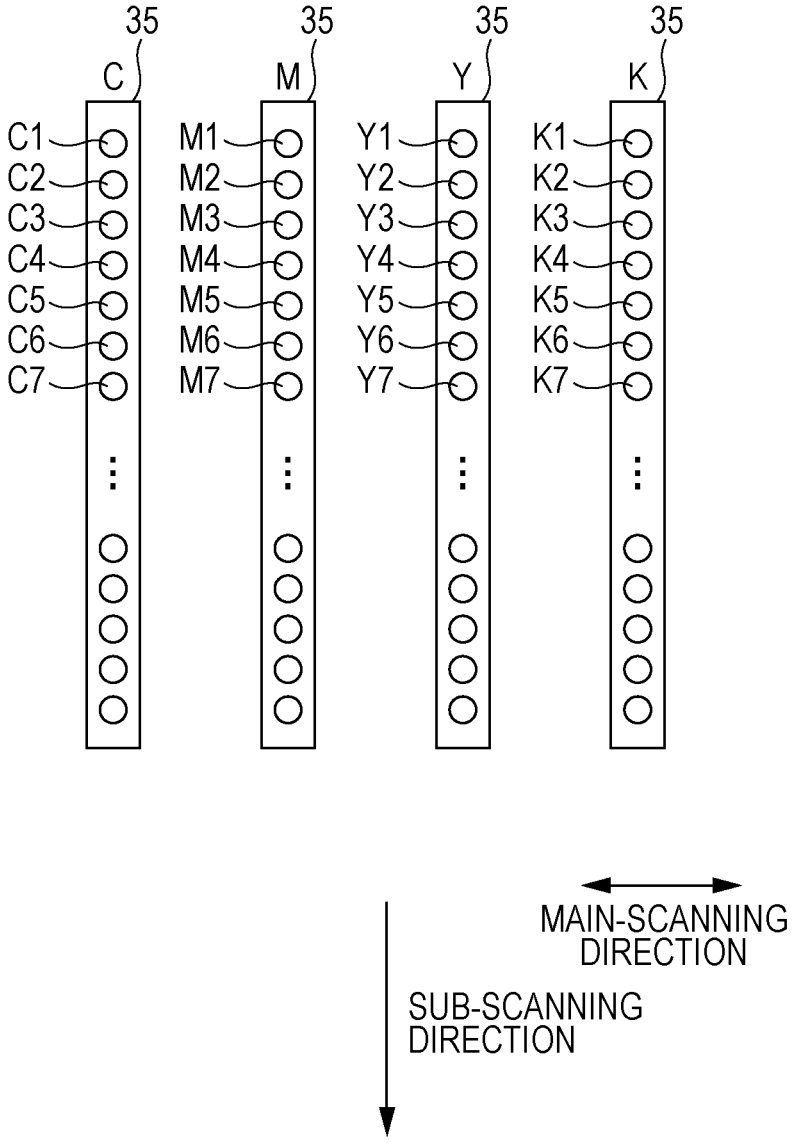
FIG. 3 is a diagram illustrating an example of the configuration of a nozzle array.

FIG. 3 is a diagram illustrating the nozzle array 35 included in the printing head 34 in detail. FIG. 3 is a diagram in which nozzles of the printing head 34 are viewed from the top (top in FIG. 2) in a see-through manner.

The nozzle array 35 is disposed for each ink color (CMYK). A plurality of nozzles (for example, C1, C2, . . . for C color) is disposed to be lined up along a sub-scanning direction (transport direction of the printing medium 100) in the nozzle array 35. Here, the nozzle is a discharge outlet for discharging ink. The number of nozzles included in the nozzle array 35 is arbitrary. The four nozzle arrays 35 moves as a whole in the main-scanning direction along with the movement of the carriage 32.

The ink tank 33 is arranged in the carriage 32. Ink accommodated in the ink tank 33 is supplied to each nozzle included in the nozzle array 35. A piezoelectric element that is deformed by a voltage applied thereto is arranged in each nozzle. Ink is discharged from each nozzle when the piezoelectric element is deformed.

An area in which ink is discharged to the printing medium 100 by the printing head 34 is the printing area.

Figure 4:
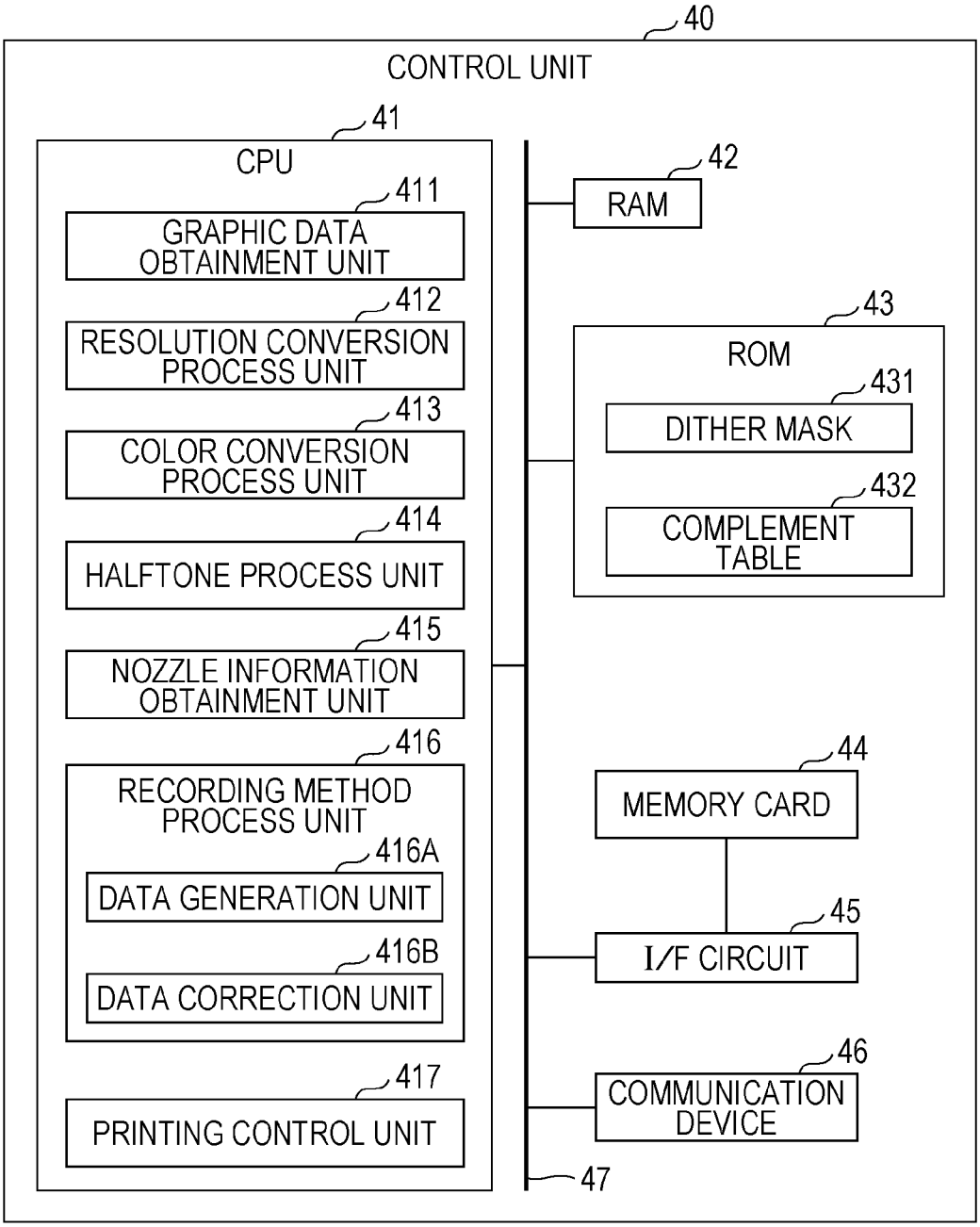
FIG. 4 is a block diagram schematically illustrating the outline configuration of a control unit.

FIG. 4 is a block diagram schematically illustrating the outline configuration of the control unit 40.

The control unit 40 mainly includes a CPU 41 that is a computing device, a RAM 42 that is a volatile storage device, a ROM 43 that is a non-volatile storage device, a memory card 44, an interface (I/F) circuit 45 that connects the control unit 40 and other units (for example, the memory card 44), a communication device 46 that communicates with devices outside the printing apparatus 1 (for example, a digital camera and the like), and a bus 47 that connects all of these together.

The CPU 41 mainly includes functional units such as a graphic data obtainment unit 411, a resolution conversion process unit 412, a color conversion process unit 413, a halftone process unit 414, a nozzle information obtainment unit 415, a recording method process unit 416, and a printing control unit 417.

Various data such as a dither mask 431 that is used in the halftone process unit 414 and a complementation table 432 that is used in the recording method process unit 416 is stored in the ROM 43. In addition, a predetermined program is stored in the ROM 43.

Each functional unit included in the CPU 41, for example, can be realized by reading the predetermined program stored in the ROM 43 into the RAM 42 and executing the program. The predetermined program, for example, may be installed in advance in the ROM 43 or may be installed or updated by being downloaded from a network through the communication device 46.

Next, each functional unit included in the CPU 41 will be described.

The graphic data obtainment unit 411 obtains graphic data of a printing target. The graphic data may be stored in the memory card 44 or may be obtained from a network through the communication device 46.

The resolution conversion process unit 412 performs a resolution conversion process on the obtained graphic data. Here, the resolution conversion process is a process of converting the graphic data (text data, image data, and the like) into graphic data having a resolution when printed on the printing medium 100 (printing resolution). For example, when the printing resolution is specified to be 720×720 dpi, the vector graphic data obtained is converted into bitmap graphic data having a resolution of 720×720 dpi. Each pixel data of the graphic data after the resolution conversion process is configured by each gradation (for example, 256 gradations) data represented by an RGB color space.

The color conversion process unit 413 performs a color conversion process of converting the graphic data in accordance with color space of the color of ink. Here, the graphic data of the RGB color space is converted into graphic data of a KCMY color space. The color conversion process is performed on the basis of a color conversion table LUT (not illustrated) in which a gradation value of RGB data is associated with a gradation value of KCMY data. The graphic data of the KCMY color space is obtained through this color conversion process. The pixel data after the color conversion process is 8-bit data with 256 gradations represented by the KCMY color space.

The halftone process unit 414 performs a halftone process of converting the data after the color conversion into data having a small number of gradations that the printing apparatus 1 can form. Here, the graphic data with 256 gradations is converted into one-bit data that indicates two gradations or two-bit data that indicates four gradations.

The halftone process unit 414 performs the halftone process using a dithering method in the present embodiment.

However, a method for the halftone process is not limited to the dithering method. For example, an error diffusion method or the like can be also used.

The data after the halftone process becomes data that indicates the formation status of a dot (presence or absence of a dot and the size of a dot) in each pixel (hereinafter, referred to as dot data).

The nozzle information obtainment unit 415 obtains the position of a nozzle that fails to discharge ink (hereinafter, referred to as a discharge-failing nozzle) such as one that cannot discharge ink and one of which the accuracy of discharge of ink is low. The position of a discharge-failing nozzle may be input by a user via an unillustrated input device or may be detected by using a sensor. General technologies can be used for a method for detecting a discharge-failing nozzle using a sensor. Thus, the method will not be described herein. The nozzle information obtainment unit 415 obtains the position of a discharge-failing nozzle that is input or detected.

The recording method process unit 416 includes a data generation unit 416A and a data correction unit 416B. The data generation unit 416A performs a rasterizing process to generate printing data. The rasterizing process is a process of sorting each pixel data which constitutes the graphic data so that each pixel data is assigned to the responsible nozzle thereof. The data correction unit 416B corrects the generated printing data on the basis of the position of a discharge-failing nozzle obtained by the nozzle information obtainment unit 415. The process performed by the recording method process unit 416 will be described in detail below.

The printing control unit 417 performs a printing operation according to the printing data. Specifically, the printing control unit 417 prints an image by controlling the transport mechanism according to the printing data and controlling the ink discharge mechanism to discharge color ink from the nozzle. A process performed by the printing control unit 417 is general and thus, will not be described in detail.

The above-described configuration of the printing apparatus 1 is a description of main constituents for describing features of the first embodiment and thus, does not limit the configuration of the printing apparatus 1. In addition, the configuration of a general printing apparatus is not excluded as the configuration of the printing apparatus 1.

Next, a featured process of the printing apparatus 1 in the first embodiment will be described.

Figure 5:
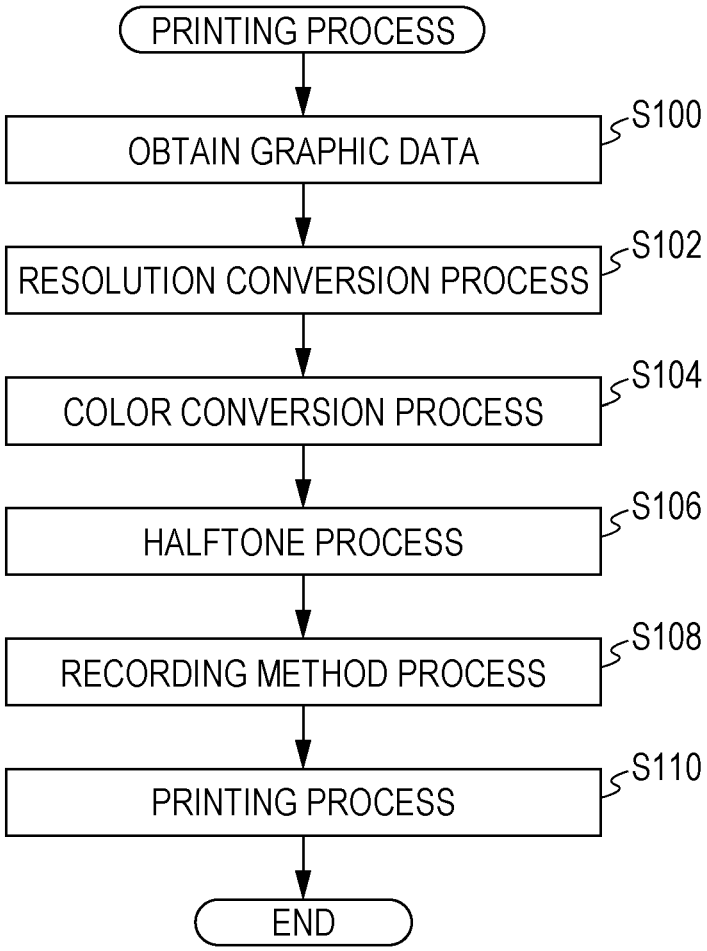
FIG. 5 is a flowchart illustrating a flow of a printing process performed by the printing apparatus.

FIG. 5 is a flowchart illustrating a flow of a printing process performed by the printing apparatus 1. This process is performed by inputting a printing start instruction via the operation button 15 or the like.

When the printing process is started, the graphic data obtainment unit 411 obtains the graphic data from the memory card 44 and the like (step S100). The resolution conversion process unit 412 converts the resolution of the graphic data obtained in step S100 into the printing resolution (step S102). The color conversion process unit 413 converts the graphic data of the RGB color space of which the resolution is converted in step S102 into graphic data of the KCMY color space (step S104). The halftone process unit 414 performs the halftone process on the multilevel gradation data converted in color in step S104 (step S106).

Thereafter, the recording method process unit 416 performs a recording method process (step S108). The recording method process in the present embodiment is a process of generating the printing data on the basis of the graphic data and then correcting the printing data on the basis of the position of a discharge-failing nozzle obtained by the nozzle information obtainment unit 415. Hereinafter, the recording method process (step S108) will be described in detail with reference to FIGS. 6 to 8B. Only one of four nozzle arrays 35 included in the printing head 34 will be described to simplify the description.

Figure 6:
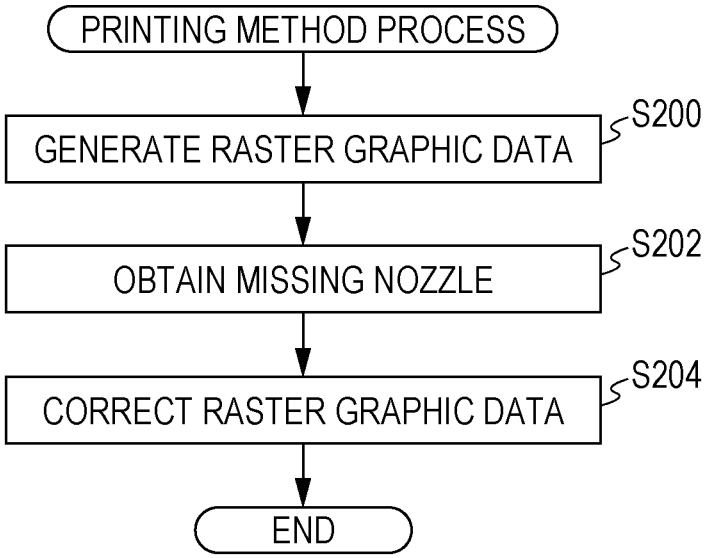
FIG. 6 is a flowchart illustrating a flow of a recording method process performed by the printing apparatus.

FIG. 6 is a flowchart illustrating a flow of the recording method process (step S108).

The data generation unit 416A determines which nozzle discharges ink to form a dot on the printing medium for each dot in the dot data after the halftone process and generates raster graphic data (step S200). Hereinafter, this process will be described with reference to FIGS. 7A, 7B, and 8A.

Figure 7A:
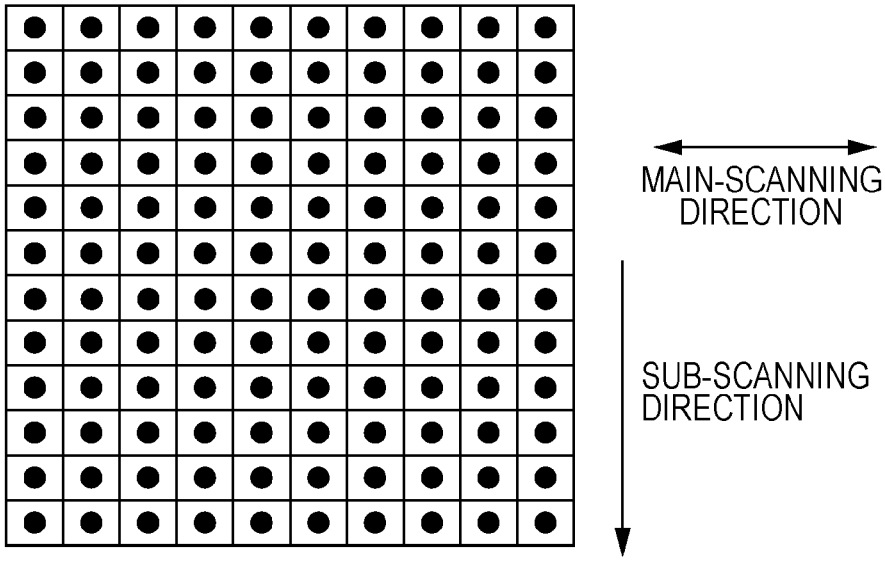
FIG. 7A is a diagram illustrating dot data after a halftone process.

FIG. 7A illustrates the dot data after the halftone process. Dots are formed at every dot position (a black circle in FIG. 7A means a formed dot) in the present embodiment. Each box illustrated in FIG. 7A is the dot position. 10 horizontal and 12 vertical boxes for a total of 120 boxes are illustrated in FIG. 7A. One raster that is one line (one row) in the main-scanning direction includes a plurality of dot positions.

Figure 7B:
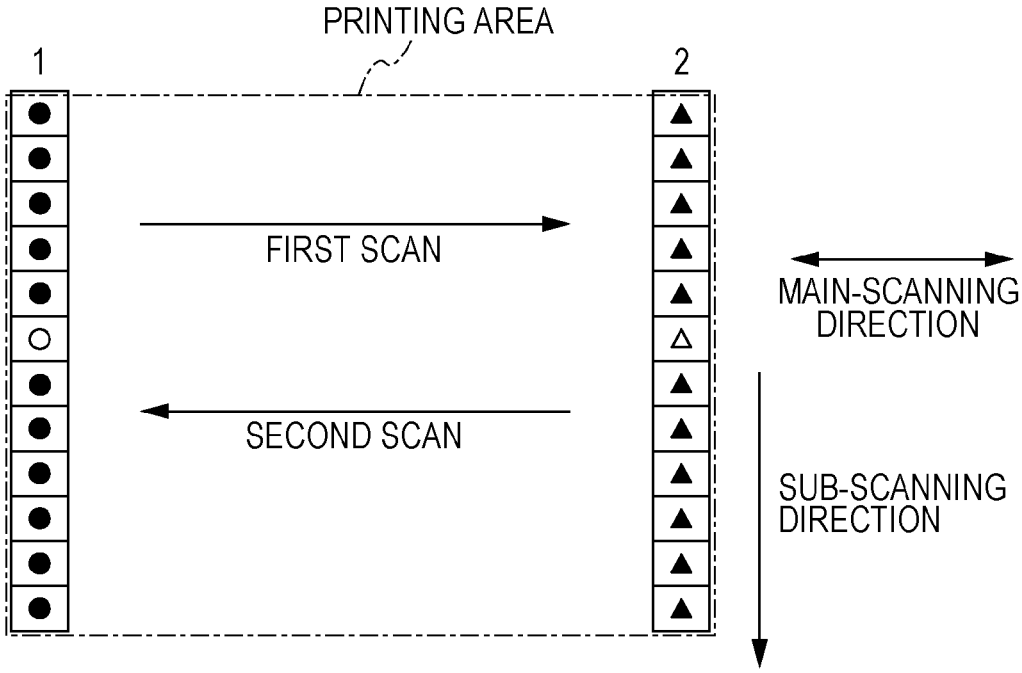
FIG. 7B is a diagram illustrating the position of nozzles in the nozzle array.

FIG. 7B is a diagram illustrating the position of nozzles in the nozzle array 35. The nozzle array 35 includes 12 nozzles in the present embodiment. In FIG. 7B, the position of each nozzle in the nozzle array 35 for the first scan is illustrated with a circle mark, and the position of each nozzle in the nozzle array 35 for the second scan is illustrated with a triangle mark. In addition, a nozzle illustrated with a black circle and a black triangle means a nozzle that does not fail to discharge ink, and a nozzle illustrated with a white circle and a white triangle means a discharge-failing nozzle.

First, the printing head 34 performs the first scan by scanning the printing medium 100 rightward in the main-scanning direction (rightward in FIG. 7B), and next, the printing head 34 performs the second scan by scanning the printing medium 100 leftward in the main-scanning direction (leftward in FIG. 7B).

In the above manner, printing is performed by adopting a printing method of forming one raster by a plurality of different nozzles through a plurality of different passes (hereinafter, referred to as overlap printing (OL printing)) in the present embodiment. In principle, one raster is formed by discharging ink from two different nozzles through two passes in the printing apparatus 1.

In the OL printing in the present embodiment, every nozzle is used to form a raster in each of the two scans, that is, all of the nozzles discharge ink. Thus, even if a blank occurs due to a discharge-failing nozzle, other nozzles cannot fill the blank.

Although the same nozzle is used to form one raster in the first scan and the second scan in FIG. 7B for convenience of description, actually, the printing medium 100 is moved in the sub-scanning direction between each scan so that different nozzles form one raster. The amount of movement (amount of transport) of the printing medium 100 in the sub-scanning direction between each scan is arbitrary.

The 2n+1-th scan (where n is an integer greater than or equal to one, that is, an odd-numbered-th scan) is the same as the first scan, and the 2n-th scan (where n is an integer greater than or equal to two, that is, an even-numbered-th scan) is the same as the second scan. Thus, the third scan and the subsequent scans will not be described hereinafter.

The printing apparatus 1 in the present embodiment performs the printing process through bidirectional printing of moving in one direction and the reverse direction. Furthermore, the present embodiment can be also applied to unidirectional printing. Here, performing one scan (moving in one direction or the reverse direction) by using the nozzle array 35 is referred to as a pass.

Figure 8A:
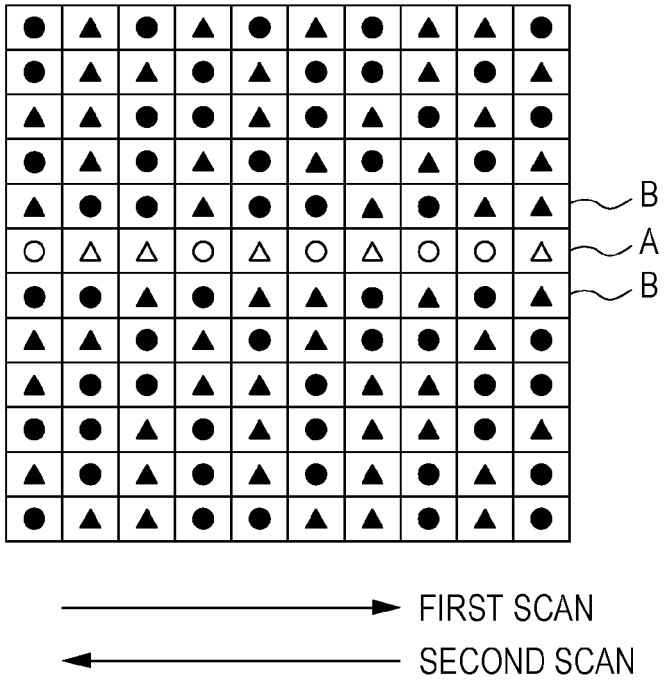
FIG. 8A is raster graphic data before correction.

FIG. 8A is a diagram illustrating which nozzle discharges ink to each dot position in the dot data.

In the OL printing, each nozzle intermittently forms a dot for every few dots. One raster is formed by forming dots so as to fill the space between dots that are already formed in another pass. "Overlap number M" is defined to be the number of passes when one raster is formed through M passes in the above manner. For example, the overlap number M is two since one raster is formed through two passes in the present embodiment.

Which nozzle discharges ink for each pixel data that constitutes the graphic data is different depending on the overlap number M, the amount of transport of the printing medium 100 in the sub-scanning direction, and the like. Accordingly, the recording method process unit 416 obtains these pieces of information (for example, stored in the ROM 43) and generates data in which each dot position that constitutes a raster is associated with a nozzle that forms a dot at the dot position as illustrated in FIG. 8A on the basis of the obtained information.

The data generation unit 416A assigns a plurality of dot positions in one raster to two passes. In FIG. 8A, the first scan is assigned to the dot position illustrated with the circle mark, and the second scan is assigned to the dot position illustrated with the triangle mark. In the above manner, one raster is formed through a plurality of different scans (two scans here), that is, by a plurality of nozzles in the OL printing in the present embodiment. Thus, banding caused by manufacturing errors (for example, the position and the size) of nozzles is prevented.

The data generation unit 416A generates the raster graphic data (corresponding to the printing data in the invention) on the basis of the result of associating information including a pass and the position of a nozzle (hereinafter, referred to as nozzle-related information) with each dot position (refer to FIG. 8A) and the dot data after the halftone process. Since dots are formed at every dot position in the present embodiment, the nozzle-related information (a pass and the position of a nozzle) and discharge of ink are associated with every dot position in the raster graphic data.

FIG. 6 is referred to again for description here. After the raster graphic data is generated in the above manner (step S200), the data correction unit 416B obtains the position of discharge-failing nozzles from the nozzle information obtainment unit 415 (step S202). The printer driver obtains the position of discharge-failing nozzles that the printing apparatus 1 obtains in step S202 when the control unit 40 is provided as the printer driver that is installed on an apparatus (a PC or the like) connected to the printing apparatus 1. Meanwhile, the order of step S200 and step S202 may be inverted.

Then, the data correction unit 416B specifies the dot position (corresponding to the first position in the invention) where a dot is formed by a discharge-failing nozzle in the raster graphic data generated in step S200 on the basis of the position of a discharge-failing nozzle obtained in step S202. In addition, the data correction unit 416B corrects the raster graphic data generated in step S200 so that a dot is not formed (ink is not discharged) at the dot position where a dot is formed by a discharge-failing nozzle, and instead, dots are formed (ink is discharged) at positions (corresponding to the second position in the invention) between which the dot position where a dot is formed by a discharge-failing nozzle is interposed along the transport direction (sub-scanning direction) (step S204). Hereinafter, this process will be described with reference to FIGS. 8A and 8B.

Figure 8B:
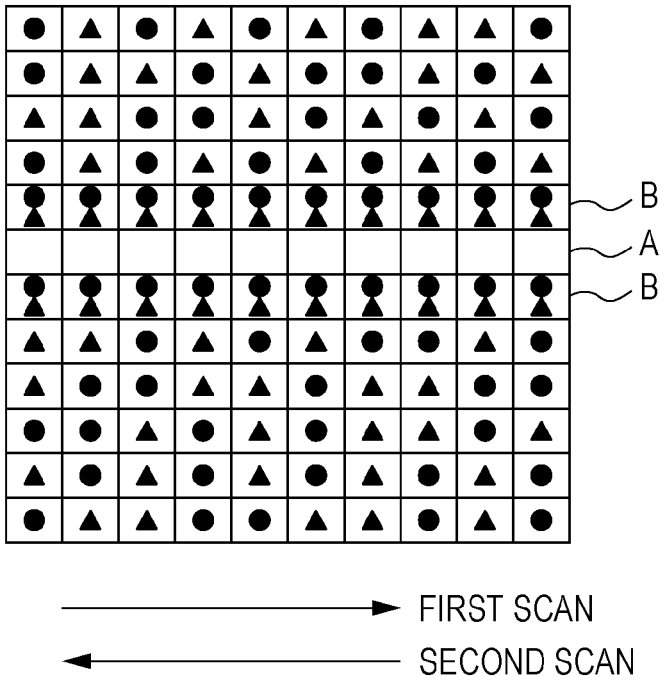
FIG. 8B is raster graphic data after correction.

FIG. 8A illustrates the raster graphic data (generated in step S200) before correction, and FIG. 8B illustrates the raster graphic data after correction. Hereinafter, associating information related to discharge of ink (for example, discharge of ink and non-discharge of ink) in the present step (step S204) means correcting the information related to discharge of ink that is associated with the dot position in step S200.

First, the data correction unit 416B associates non-discharge of ink with the dot position where a dot is formed by a discharge-failing nozzle. The dot position (corresponding to the first position in the invention) where a dot is formed by a discharge-failing nozzle is a raster A in FIGS. 8A and 8B. The data correction unit 416B associates non-discharge of ink with the raster A after obtaining information in step S202. Accordingly, the raster A becomes blank in FIG. 8B.

Next, the data correction unit 416B associates discharge of ink with the positions (corresponding to the second position in the invention) between which the dot position where a dot is formed by a discharge-failing nozzle is interposed along the transport direction (sub-scanning direction).

In FIG. 8B, the positions between which the raster A is interposed along the transport direction (sub-scanning direction) are rasters up and down of the raster A (raster B). Accordingly, the data correction unit 416B associates discharge of ink with the raster B. Since discharge of ink is already associated with the raster B in FIG. 8A, two times of discharge of ink of originally discharged ink and additionally discharged ink are associated with the raster B in FIG. 8B.

Since the OL printing is performed in the present embodiment, the OL printing is set in such a manner that ink is discharged only to the dot position of a part of a raster in one pass in the nozzle array 35. Accordingly, regarding the raster B, the data correction unit 416B releases the setting of the OL printing so that ink is discharged to every dot position that constitutes a raster in one pass. Therefore, ink can be discharged to every dot position that constitutes the raster B in each of two passes.

In the above manner, the raster graphic data is corrected as illustrated in FIG. 8B, discharge of ink is associated with every dot position that constitutes a raster in the first scan with respect to the raster B, and further, discharge of ink is associated with every dot position that constitutes a raster even in the second scan. Thus, the process in step S108 is ended.

FIG. 5 is referred to again for description here. The printing control unit 417 performs printing by discharging ink to the printing medium 100 from each nozzle included in the printing head 34 using the raster graphic data corrected in step S108 (step S110). The raster graphic data corrected in step S108 is output to the printing apparatus 1 in step S110 when the control unit 40 is provided as the printer driver that is installed on an apparatus (for example, a PC) connected to the printing apparatus 1.

According to the first embodiment, ink is not discharged to the dot position where a dot is formed by a discharge-failing nozzle. Instead, ink is discharged to the positions between which the dot position where a dot is formed by a discharge-failing nozzle is interposed along the transport direction (sub-scanning direction). Thus, dots that are supposed to be originally formed at the positions between which the dot position where a dot is formed by a discharge-failing nozzle is interposed along the transport direction (sub-scanning direction) are formed, and a blank that occurs at the dot position where a dot is formed by a discharge-failing nozzle is covered. Accordingly, a blank (banding) due to discharge failure can be suppressed even when a normal nozzle is not used to discharge ink to a pixel where a nozzle that fails to discharge ink is supposed to originally discharge ink.

In addition, according to the first embodiment, banding can be prevented from occurring by discharging ink twice to rasters between which a blank raster is interposed using a different nozzle even when the entire raster is blank due to a discharge-failing nozzle.

Banding is caused by manufacturing errors of nozzles when, for example, nozzles that are adjacent to a nozzle which fails to discharge ink are used to discharge ink to a position where the nozzle which fails to discharge ink is supposed to originally discharge ink in a case where ink is discharged so as to fill the dot position where a dot is formed by a discharge-failing nozzle (for example, the invention described in JP-A-2000-94662). However, a different nozzle is used to discharge ink twice to a position where a nozzle that fails to discharge ink is supposed to originally discharge ink in the first embodiment. Thus, even if the position of a nozzle is displaced in the sub-scanning direction, a blank pixel due to discharge failure does not stand out.

Although the printing medium 100 is not transported in the sub-scanning direction between the first scan and the second scan in the present embodiment, the printing medium 100 may be transported in the sub-scanning direction by half (half pitch) the distance (pitch) between nozzles included in the nozzle array 35 between the first scan and the second scan. Accordingly, banding can be further prevented from standing out.

In addition, although ink is discharged twice to each dot position that constitutes the raster B in the present embodiment, the number of discharge of ink to each dot position that constitutes the raster B is not limited to two provided that the number is plural.

Second Embodiment

Although the entire raster is the dot position where a dot is formed by a discharge-failing nozzle in the first embodiment of the invention, it cannot be said that the entire raster is the dot position where a dot is formed by a discharge-failing nozzle.

A second embodiment of the invention is an embodiment in which a part of a raster is the dot position where a dot is formed by a discharge-failing nozzle when the overlap printing is performed. Hereinafter, a printing apparatus 2 of the second embodiment will be described. The configuration of the printing apparatus 2 will not be described, and only a featured process performed by the printing apparatus 2 will be described because the printing apparatus 2 in the second embodiment has the same configuration as the printing apparatus 1 in the first embodiment. In addition, the same parts as those in the first embodiment are given the same reference signs and will not be described in the description of the process.

Figure 9:
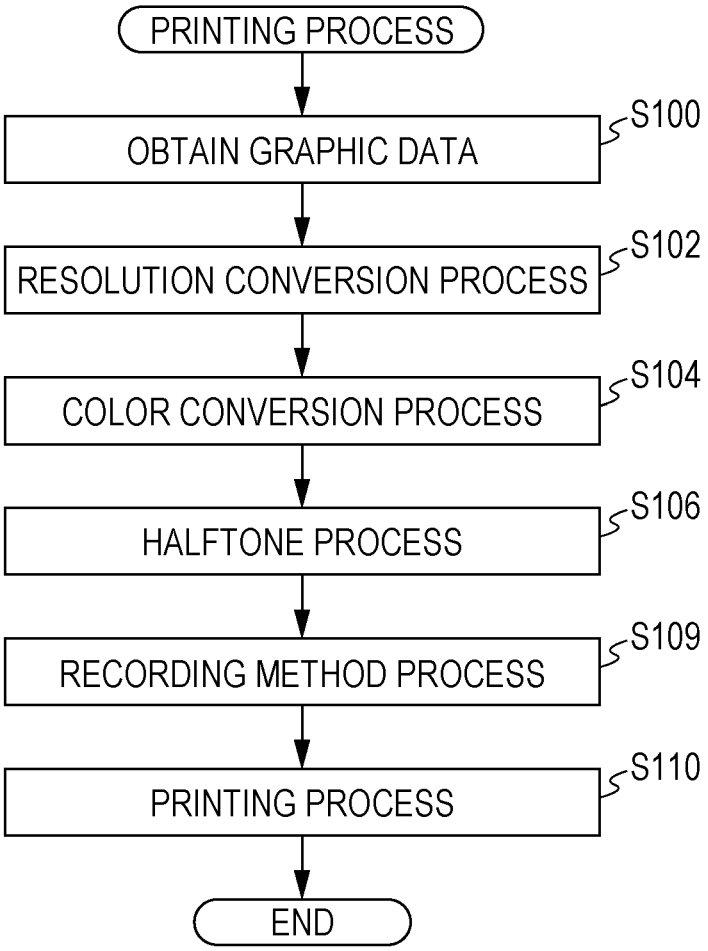
FIG. 9 is a flowchart illustrating a flow of a printing process performed by a printing apparatus in a second embodiment.

FIG. 9 is a flowchart illustrating a flow of a printing process performed by the printing apparatus 2. This process is performed by inputting a printing start instruction via a button or the like.

When the printing process is started, the graphic data obtainment unit 411 obtains the graphic data from the memory card 44 and the like (step S100). The resolution conversion process unit 412 converts the resolution of the graphic data obtained in step S100 into the printing resolution (step S102). The color conversion process unit 413 converts the graphic data of the RGB color space of which the resolution is converted in step S102 into graphic data of the KCMY color space (step S104). The halftone process unit 414 performs the halftone process on the multilevel gradation data converted in color in step S104 (step S106).

Thereafter, the recording method process unit 416 generates the printing data on the basis of the graphic data and then corrects the printing data on the basis of the position of a discharge-failing nozzle obtained by the nozzle information obtainment unit 415 (step S109). Hereinafter, the recording method process (step S109) will be described in detail with reference to FIG. 10.

Figure 10:
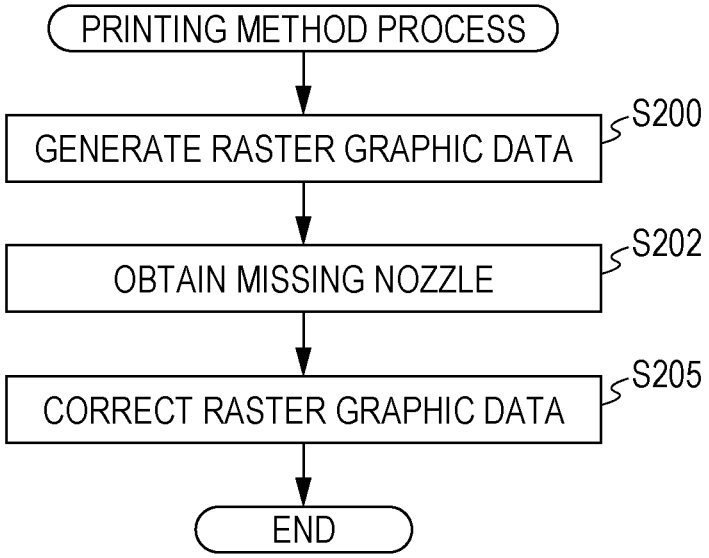
FIG. 10 is a flowchart illustrating a flow of a recording method process performed by the printing apparatus.

FIG. 10 is a flowchart illustrating a flow of the recording method process (step S109).

The data generation unit 416A determines which nozzle discharges ink to form a dot on the printing medium for each dot in the dot data after the halftone process and generates raster graphic data (step S200). Hereinafter, this process will be described with reference to FIGS. 11A and 11B and FIG. 12A.

Figure 11A:
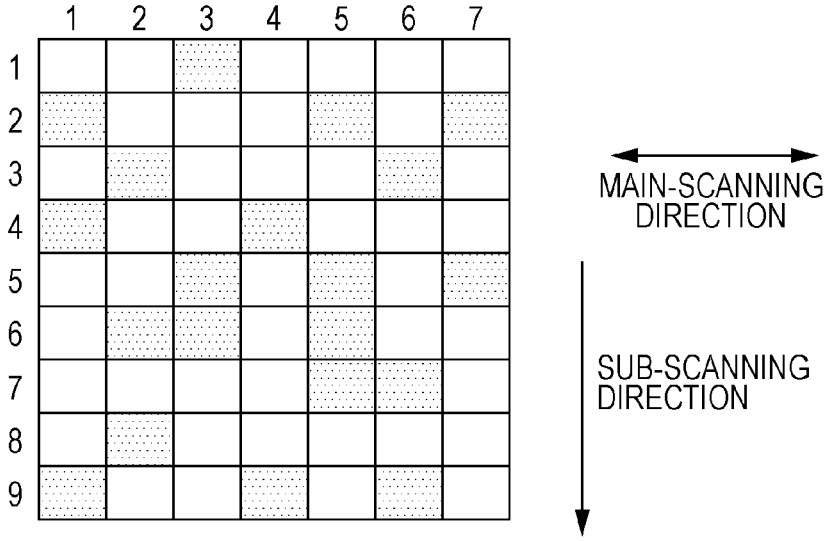
FIG. 11A is a diagram illustrating dot data after a halftone process.

FIG. 11A illustrates the dot data after the halftone process. In FIG. 11A, hatched boxes mean that ink is discharged thereto, and boxes without hatching mean that ink is not discharged thereto.

Figure 11B:
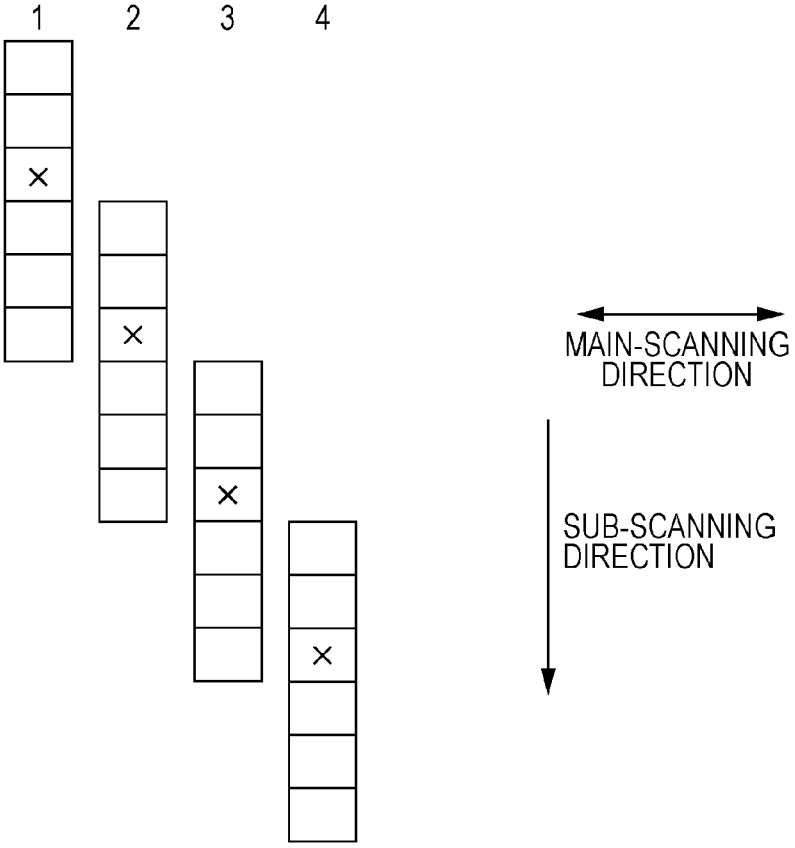
FIG. 11B is a diagram illustrating the position of nozzles in the nozzle array.

FIG. 11B is a diagram illustrating the position of nozzles in the nozzle array 35. The nozzle array 35 includes six nozzles in the present embodiment. In FIG. 11B, a nozzle displayed with a x mark means a discharge-failing nozzle. A number displayed over each nozzle array indicates the order of scanning.

The OL printing is performed with the overlap number M=4 in the present embodiment. First, the printing head 34 performs the first scan by scanning the printing medium 100 rightward in the main-scanning direction (rightward in FIG. 11B). Next, the printing medium 100 is transported in the sub-scanning direction by a distance corresponding to three nozzles, and the printing head 34 performs the second scan by scanning the printing medium 100 leftward in the main-scanning direction (leftward in FIG. 11B).

For the third scan and the fourth scan, the printing medium 100 is transported in the sub-scanning direction by the distance corresponding to three nozzles, and then the printing head 34 scans the printing medium 100 rightward or leftward in the main-scanning direction like in the second scan.

Bidirectional printing is performed even in a second embodiment like in the first embodiment. The 2n+1-th scan (where n is an integer greater than or equal to 0, that is, an odd-numbered-th scan) is performed rightward in the main-scanning direction, and the 2n-th scan (where n is an integer greater than or equal to one, that is, an even-numbered-th scan) is performed leftward in the main-scanning direction.

The fifth to the eighth scans, the ninth to the twelfth scans, . . . are the same as the first to the fourth scans and thus will not be described.

Although the printing head 34 is described as moving relatively with respect to the printing medium 100 in FIG. 11B for description purposes, the printing medium 100 actually moves in the sub-scanning direction.

FIG. 12A is a diagram illustrating which nozzle discharges ink to each dot position in the dot data. The dot position and a nozzle that forms a dot at the dot position are associated with each other in FIG. 12A.

The data generation unit 416A assigns a plurality of dot positions in one raster to two passes. A number displayed in each box in FIG. 12A indicates in which pass a dot is formed. In FIG. 12A, the fourth to the sixth nozzles are assigned to the odd-numbered-th columns in the first to the third rows in the first scan (first pass). The first to the sixth nozzles are assigned to the even-numbered-th columns in the first to the sixth rows in the second scan (second pass). The first to the sixth nozzles are assigned to the odd-numbered-th columns in the fourth to the ninth rows in the third scan (third pass). The first to the third nozzles are assigned to the even-numbered-th columns in the seventh to the ninth rows in the fourth scan (fourth pass). In addition, a box with the x mark is the dot position to which a discharge-failing nozzle is assigned in FIG. 12A.

The data generation unit 416A generates the raster graphic data (corresponding to the printing data in the invention) as illustrated in FIG. 12B on the basis of the result illustrated in FIG. 12A and the dot data after the halftone process. For example, when the data illustrated in FIG. 11A and the data illustrated in FIG. 12A are crossed, blank boxes in FIG. 11A become blank, and only hatched boxes in FIG. 11A remain as illustrated in FIG. 12B.

FIG. 10 is referred to again for description here. After the raster graphic data is generated in the above manner (step S200), the data correction unit 416B obtains the position of discharge-failing nozzles from the nozzle information obtainment unit 415 (step S202).

Then, the data correction unit 416B specifies the dot position (corresponding to the first position in the invention) where a dot is formed by a discharge-failing nozzle in the raster graphic data generated in step S200 on the basis of the position of a discharge-failing nozzle obtained in step S202. In addition, the data correction unit 416B corrects the raster graphic data generated in step S200 so that a dot is not formed (ink is not discharged) at the dot position where a dot is formed by a discharge-failing nozzle, and instead, dots are formed (ink is discharged) at positions (corresponding to the second position in the invention) between which the dot position where a dot is formed by a discharge-failing nozzle is interposed along the transport direction (sub-scanning direction) (step S205). Hereinafter, this process will be described with reference to FIGS. 12B and 12C.

FIG. 12B illustrates the raster graphic data (generated in step S200) before correction, and FIG. 12C illustrates the raster graphic data after correction.

First, the data correction unit 416B associates non-discharge of ink with the dot position where a dot is formed by a discharge-failing nozzle. When non-discharge of ink is associated with the dot position where a dot is formed by a discharge-failing nozzle (corresponding to the first position in the invention), the position with the × mark in FIG. 12B becomes blank in FIG. 12C.

Next, the data correction unit 416B associates discharge of ink with the positions (positions up and down of the position with the × mark in FIG. 12B that correspond to the second position in the invention) between which a dot position (the position with the × mark in FIG. 12B) where a dot is formed by a discharge-failing nozzle is interposed along the transport direction (sub-scanning direction) using the complementation table 432 (refer to FIGS. 13A and 13B) (complementation process). Hereinafter, the complementation process will be described specifically.

In the complementation process of the box at the third row and the second column in FIG. 12B, the data correction unit 416B first blanks out the box at the third row and the second column as illustrated in FIG. 12C. Next, the data correction unit 416B determines a case to which the boxes up and down of the box at the third row and the second column (the box at the second row and the second column and the box at the fourth row and the second column) correspond among cases defined in the complementation table 432.

FIGS. 13A and 13B are diagrams illustrating an example of the complementation table 432. FIG. 13A illustrates conditions of discharging ink before the complementation process, and FIG. 13B illustrates conditions of discharging ink after the complementation process. In FIGS. 13A and 13B, a missing pixel is the dot position where a dot is formed by a discharge-failing nozzle, and a complementation pixel is the pixel at the positions between which the dot position where a dot is formed by a discharge-failing nozzle is interposed along the sub-scanning direction. The data correction unit 416B refers to the complementation table 432 and switches conditions (ON or a double hit) of discharging ink to the complementation pixel depending on conditions (ON or OFF) of discharging ink that are assigned in advance to the complementation pixel where the missing pixel is complemented. Here, the double hit means discharging ink twice (not necessarily to be simultaneous).

In FIG. 12B, the box at the third row and the second column (the dot position where a dot is formed by a discharge-failing nozzle) is hatched (dot ON), and the box at the second row and the second column and the box at the fourth row and the second column (the positions between which the dot position where a dot is formed by a discharge-failing nozzle is interposed along the sub-scanning direction) are blank (dot OFF). Thus, this corresponds to the case No. 2 in a complementation table 432A illustrated in FIG. 13A.

Accordingly, the data correction unit 416B refers to the case No. 2 in a complementation table 432B illustrated in FIG. 13B and associates discharge of ink with the box at the second row and the second column and the box at the fourth row and the second column in FIG. 12C.

In addition, the data correction unit 416B refers to FIG. 12A and determines which nozzle has to discharge ink to the dot position that is newly associated with discharge of ink. Since the pass two is assigned to each of the box at the second row and the second column and the box at the fourth row and the second column in FIG. 12A, the data correction unit 416B associates the pass two with the box at the second row and the second column and the box at the fourth row and the second column in FIG. 12C.

Accordingly, the number two is input to the box at the second row and the second column and the box at the fourth row and the second column in FIG. 12C.

In the complementation process of the box at the sixth row and the fifth column in FIG. 12B, the data correction unit 416B first blanks out the box at the sixth row and the fifth column as illustrated in FIG. 12C. Next, the data correction unit 416B determines a case to which the boxes up and down of the box at the sixth row and the fifth column (the box at the fifth row and the fifth column and the box at the seventh row and the fifth column) correspond among the cases defined in the complementation table 432.

In FIG. 12B, the box at the sixth row and the fifth column (the dot position where a dot is formed by a discharge-failing nozzle) is hatched (dot ON), and the box at the fifth row and the fifth column and the box at the seventh row and the fifth column (the positions between which the dot position where a dot is formed by a discharge-failing nozzle is interposed along the sub-scanning direction) are also hatched (dot ON). Thus, this corresponds to the case No. 1 in the complementation table 432A illustrated in FIG. 13A.

Accordingly, the data correction unit 416B refers to the case No. 1 in the complementation table 432B illustrated in FIG. 13B and associates two times of discharge of ink (double hit) with the box at the fifth row and the fifth column and the box at the seventh row and the fifth column in FIG. 12C.

In addition, the data correction unit 416B refers to FIG. 12A and determines which nozzle has to discharge ink to the box at the fifth row and the fifth column and the box at the seventh row and the fifth column. Boxes that are adjacent to the box at the fifth row and the fifth column in the main-scanning direction in FIG. 12A are associated with the pass two. Thus, the data correction unit 416B associates the pass two with the box at the fifth row and the fifth column in addition to the pass three that is already assigned to the box. In addition, boxes that are adjacent to the box at the seventh row and the fifth column in the main-scanning direction in FIG. 12A are associated with the pass four. Thus, the data correction unit 416B associates the pass four with the box at the fifth row and the fifth column in addition to the pass three that is already assigned to the box.

Accordingly, the box at the fifth row and the fifth column in FIG. 12C is associated with the number two and the number three, and the box at the seventh row and the fifth column in FIG. 12C is associated with the number three and the number four. Therefore, a dot can be formed at the same dot position through different passes.

Furthermore, regarding a raster that includes the complementation pixel, the data correction unit 416B releases the setting of an OL nozzle so that ink can be discharged to the adjacent dot position. The data correction unit 416B may release the setting of the OL nozzle with respect to the entire raster that includes the complementation pixel or may release the setting of the OL nozzle only with respect to the complementation pixel.

Here, when the dot position where a dot is formed by a discharge-failing nozzle in FIG. 12A is not hatched in the data after the halftone process (when corresponding to the cases No. 3 and 4 in which the condition at the missing pixel is dot OFF in FIGS. 13A and 13B), the dot position becomes blank in FIG. 12B, and the complementation process is not performed. For this reason, the conditions of discharging ink associated with the complementation pixel in the raster graphic data are not modified. Accordingly, unnecessary forming of dots can be prevented.

Meanwhile, the data correction unit 416B may perform the complementation process on the basis of FIG. 13B even when the dot position where a dot is formed by a discharge-failing nozzle in FIG. 12A is not hatched in the data after the halftone process. Since the conditions of discharging ink to the complementation pixel are the same in the cases No. 3 and 4 in FIGS. 13A and 13B, the conditions of discharging ink associated with the complementation pixel are not modified even if the complementation process is performed.

In the above manner, the raster graphic data is corrected, and the process in step S109 is ended.

FIG. 9 is referred to again for description here. The printing control unit 417 performs printing by discharging ink to the printing medium 100 from each nozzle included in the printing head 34 using the raster graphic data corrected in step S109 (step S110).

In the present embodiment, dots are formed continuously at the dot positions in the main-scanning direction in a case of performing the complementation process, while every other dot is formed in one pass in a case of not performing the complementation process. Accordingly, the printing control unit 417 forms dots at the continuous dot positions using any method of the following two methods.

A first method is a method of increasing the frequency of discharge of ink. When forming dots at the continuous dot positions, the printing control unit 417 discharges ink at an interval that is half of an interval in not performing the complementation process. Accordingly, printing can be performed without a decrease in speed.

A second method is a method of decreasing the speed of the carriage. When forming dots at the continuous dot positions, the printing control unit 417 moves the carriage 32 in the main-scanning direction at a speed that is double of a speed of movement of the carriage 32 in the main-scanning direction in not performing the complementation process. Accordingly, dots can be stably formed continuously at the adjacent dot positions by using the same nozzle.

According to the present embodiment, the conditions (ON or the double hit) of discharging ink to the complementation pixel are switched depending on the conditions (ON or OFF) of discharging ink that are assigned in advance to the complementation pixel where the missing pixel is complemented. Thus, image quality after complementation can be increased.

Figure 14A:
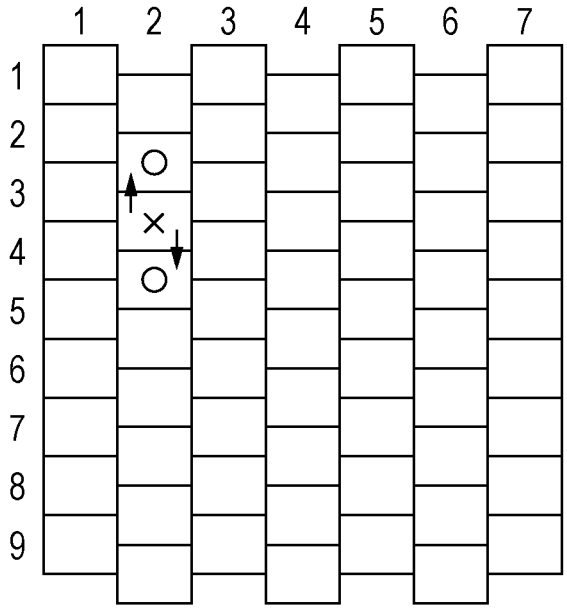
FIGS. 14A and 14B are diagrams illustrating a modification example.
Figure 14B:
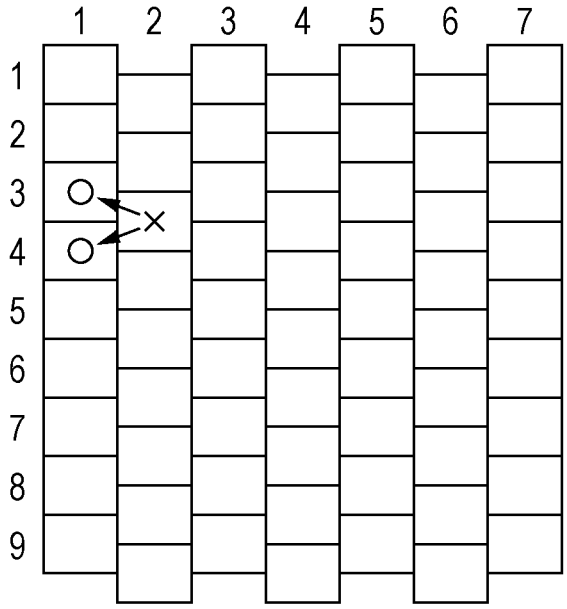

Although the dot positions are lined up leftward, rightward, upward, and downward (lattice shape) in the first embodiment and the second embodiment, the arrangement of the dot positions is not limited to this. For example, the dot positions in one column that is adjacent to another may be lined up being displaced by half the size of a dot as illustrated in FIGS. 14A and 14B (zigzag lattice). In this case, the positions between which the dot position where a dot is formed by a discharge-failing nozzle is interposed along the sub-scanning direction may be the dot positions (positions up and down of the dot position) in the same column as illustrated in FIG. 14A or may be the adjacent dot positions (positions diagonally up and down of the dot position) as illustrated in FIG. 14B.

Hereinbefore, the invention is described by using the embodiments, but the technical range of the invention is not limited to the range described in the above embodiments. It is apparent for those skilled in the related art that various modifications or improvements can be made to the embodiments described above. In addition, it is apparent from the appended claims that embodiments with such modifications or improvements can be included in the technical range of the invention. Furthermore, the invention can be also embodied by combining a plurality of embodiments.

Particularly, the invention may be provided as an apparatus such as the printing apparatus in which a printing control device is disposed or may be provided as the printing control device. In addition, the invention can be provided as a program that controls the printing control device and the like or as a recording medium in which the program is stored.

What is claimed is:

1. A printing control device comprising:

a nozzle information obtainment unit that obtains the position of a discharge-failing nozzle which fails to discharge ink in a printing head which includes a nozzle array in which a plurality of nozzles discharging ink to a printing medium is lined up in a transport direction of the printing medium;

a data generation unit that generates printing data in which a dot position is associated with a nozzle which discharges ink so that a raster which is one line in a scanning direction of the printing head and is configured by a plurality of dot positions is configured through multiple times of a scan; and a data correction unit that specifies a first position which is the position where ink is discharged by a discharge-failing nozzle in the printing data on the basis of the position of the discharge-failing nozzle obtained and corrects the printing data to generate corrected printing data so that non-discharge of ink is associated with the first position, and discharge of ink is associated with a second position between which the first position is interposed along the transport direction when discharge of ink is associated with the first position in the printing data generated, wherein the corrected printing data discharged at the second position causes the ink to be discharged from a discharge-failing nozzle in the printing data prior to the correction to be discharged by the discharge-nozzle which is adjacent to the discharge-failing nozzle during a first scan in the scanning direction while the corrected printing data for the discharge-nozzle causes dots of the printing data assigned to the discharge-nozzle in the printing data prior to the correction to be discharged from the discharge-nozzle in a second scan in the scanning direction, wherein the data correction unit corrects the printing data so that ink is discharged multiple times to the second position when discharge of ink is associated with the second position in the printing data prior to correction of the printing data, and wherein the printing medium is transported in the sub-scanning direction by half a distance between nozzles included in the nozzle array between the first scan and the second scan.

2. The printing control device according to claim 1, wherein the data correction unit corrects the printing data so that ink is discharged by using a nozzle that is associated with the second position in the printing data generated and nozzles that are associated with positions which are adjacent to the second position in the same raster in which the second position is in the printing data generated when ink is discharged multiple times to the second position.

3. The printing control device according to claim 1, wherein the data correction unit does not correct the printing data when discharge of ink is not associated with the first position in the printing data generated.

4. The printing control device according to claim 1, wherein the nozzle information obtainment unit obtains a plurality of discharge-failing nozzles, the first position is a position where ink is discharged by each of the plurality of discharge-failing nozzles obtained, and the data correction unit corrects the printing data so that ink is discharged in one scan to every dot position that constitutes the raster and is the second position when the first position is the entire raster.

5. The printing control device according to claim 1, further comprising:

an output unit that outputs the printing data corrected by the data correction unit and outputs an instruction to reduce a speed at which the printing head is moved in the scanning direction by half when the second positions are adjacent to each other in the raster compared with when the second positions are not adjacent to each other in the raster.

6. A printing control method comprising:

obtaining the position of a discharge-failing nozzle which fails to discharge ink in a printing head which includes a nozzle array in which a plurality of nozzles discharging ink to a printing medium is lined up in a transport direction of the printing medium;

generating printing data in which a dot position is associated with a nozzle which discharges ink so that a raster which is one line in a scanning direction of the printing head and is configured by a plurality of dot positions is configured through multiple times of a scan; and specifying a first position which is the position where ink is discharged by a discharge-failing nozzle in the printing data on the basis of the position of the discharge-failing nozzle obtained and correcting the printing data to generate corrected printing data so that non-discharge of ink is associated with the first position, and discharge of ink is associated with a second position between which the first position is interposed along the transport direction when discharge of ink is associated with the first position in the printing data generated, wherein the corrected printing data discharged at the second position causes the ink to be discharged from a discharge-failing nozzle in the printing data prior to the correction to be discharged by the discharge-nozzle which is adjacent to the discharge-failing nozzle during a first scan in the scanning direction while the corrected printing data for the discharge-nozzle causes dots of the printing data assigned to the discharge-nozzle in the printing data prior to the correction to be discharged from the discharge-nozzle in a second scan in the scanning direction, wherein the printing data is corrected so that ink is discharged multiple times to the second position when discharge of ink is associated with the second position in the printing data prior to correction of the printing data, and wherein the printing medium is transported in the sub-scanning direction by half a distance between nozzles included in the nozzle array between the first scan and the second scan.

7. A non-transitory computer readable storage medium storing computer program, the program causing a computer to function as a printing control device and to execute:

obtaining the position of a discharge-failing nozzle which fails to discharge ink in a printing head which includes a nozzle array in which a plurality of nozzles discharging ink to a printing medium is lined up in a transport direction of the printing medium;

generating printing data in which a dot position is associated with a nozzle which discharges ink so that a raster which is one line in a scanning direction of the printing head and is configured by a plurality of dot positions is configured through multiple times of a scan; and specifying a first position which is the position where ink is discharged by a discharge-failing nozzle in the printing data on the basis of the position of the discharge-failing nozzle obtained and correcting the printing data to generate corrected printing data so that non-discharge of ink is associated with the first position, and discharge of ink is associated with a second position between which the first position is interposed along the transport direction when discharge of ink is associated with the first position in the printing data generated, wherein the corrected printing data discharged at the second position causes the ink to be discharged from a discharge-failing nozzle in the printing data prior to the correction to be discharged by the discharge-nozzle which is adjacent to the discharge-failing nozzle during a first scan in the scanning direction while the corrected printing data for the discharge-nozzle causes dots of the printing data assigned to the discharge-nozzle in the printing data prior to the correction to be discharged from the discharge-nozzle in a second scan in the scanning direction, wherein the printing data is corrected so that ink is discharged multiple times to the second position when discharge of ink is associated with the second position in the printing data prior to correction of the printing data, wherein the printing medium is transported in the sub-scanning direction by half a distance between nozzles included in the nozzle array between the first scan and the second scan.

* * * * *